US007044033B2

(12) United States Patent
Hirse

(10) Patent No.: US 7,044,033 B2
(45) Date of Patent: May 16, 2006

(54) CLAMPING WRENCH

(75) Inventor: Gernot Hirse, Neu-Isenburg (DE)

(73) Assignee: Knipex-Werk C. Gustav Putsch KG, Wuppertal (DE)

( * ) Notice: Subject to any disclaimer, the term of this patent is extended or adjusted under 35 U.S.C. 154(b) by 0 days.

(21) Appl. No.: 10/467,287

(22) PCT Filed: Jan. 26, 2002

(86) PCT No.: PCT/EP02/00832

§ 371 (c)(1),
(2), (4) Date: Jan. 16, 2004

(87) PCT Pub. No.: WO02/062533

PCT Pub. Date: Aug. 15, 2002

(65) Prior Publication Data

US 2004/0129117 A1 Jul. 8, 2004

(30) Foreign Application Priority Data

Feb. 8, 2001 (DE) ..... 101 05 653

(51) Int. Cl.
*B25B 7/04* (2006.01)

(52) U.S. Cl. ..... 81/418; 81/385; 81/412

(58) Field of Classification Search ..... 81/99, 81/355, 411, 412, 418, 358, 385, 393, 415, 81/100, 101, 106, 109, 111, 129, 129.5, 134, 81/140, 386, 394, 407, 424.5
See application file for complete search history.

(56) References Cited

U.S. PATENT DOCUMENTS

| | | | | |
|---|---|---|---|---|
| 1,634,908 | A * | 7/1927 | Lynch et al. | 81/99 |
| 2,152,563 | A * | 3/1939 | Palmer et al. | 81/412 |
| 2,194,049 | A | 3/1940 | Mead | |
| 2,606,473 | A * | 8/1952 | Carnelli | 81/99 |
| 2,958,246 | A * | 11/1960 | Osborn | 81/99 |
| 3,635,107 | A * | 1/1972 | Schmidt | 81/418 |
| 4,651,597 | A | 3/1987 | Yang | |
| 6,026,714 | A | 2/2000 | Chang | |
| 6,092,440 | A * | 7/2000 | Hillinger | 81/99 |
| 6,311,586 | B1 * | 11/2001 | Hirse | 81/99 |
| 6,339,978 | B1 * | 1/2002 | Hirse | 81/99 |

FOREIGN PATENT DOCUMENTS

| | | |
|---|---|---|
| DE | 1603798 | 2/1971 |
| DE | 4445827 | 6/1996 |
| DE | 19518555 | 11/1996 |
| DE | 19930367 | 1/2001 |
| EP | 0610695 | 8/1994 |

* cited by examiner

*Primary Examiner*—David B. Thomas
(74) *Attorney, Agent, or Firm*—Martin A. Farber

(57) ABSTRACT

The invention relates to a spanner for hexagonal shaped objects (5), comprising an upper and lower jaw (1 or 2), which are respectively connected in a single-piece to the limb of a handle (4 or 3). Both jaws (1, 2) are connected together in a pivoting manner in a length-adjustable single joint (6). The upper jaw (1) comprises a flat, smooth clamping surface (9) and a stop (10). The lower jaw (2) comprises a curved convex, flat clamping cam surface (11), which lies adjacent to a respectively associated lower flank surface (12) for all hexagonal objects (5) of all wrench sizes which are to be accommodated.

10 Claims, 6 Drawing Sheets

CLAMPING WRENCH

FIELD AND BACKGROUND OF THE INVENTION

The invention relates to a clamping wrench for hexagonal objects with an upper wrench jaw and a lower wrench jaw, which are respectively connected in a unitary manner to a limb of the handle, the wrench jaws being pivotably connected to each other in a longitudinally adjustable single joint.

Clamping wrenches of this type are known in various embodiments, as so-called water-pump wrenches with a serrated surface (DE 199 30 367 A1) and as so-called fittings wrenches with smooth clamping surfaces. On these, the lower wrench jaw and the upper wrench jaw have two surfaces disposed at an angle of 120° in relation to each other, with the result that hexagonal objects, in particular nuts, screw heads or union nuts of screwed pipe connections, can be received between the upper wrench jaw and the lower wrench jaw. Corners of the hexagonal object lying opposite one another are in each case at the deepest point of the two wrench jaws, the surfaces of which, disposed at 120° in relation to each other, lie against neighboring flank surfaces of the hexagonal object.

The longitudinally adjustable form of the single joint, which allows at least two, but in most cases more than two, relative positions of the two wrench jaws, makes it possible to receive hexagonal objects with different widths across flats.

However, it is only ensured that a hexagonal object is exactly received with the two wrench jaws lying against four flank surfaces of the hexagonal object if the fixable positions of the longitudinally adjustable single joint are chosen such that the two wrench jaws are aligned parallel to each other when the respective hexagonal object is received. In the case of all other hexagonal objects of different widths across flats, the wrench jaws are not aligned parallel to each other, with the result that only the two surfaces of one of the two wrench jaws, usually the upper wrench jaw, come properly to lie against neighboring flank surfaces of the hexagonal object, while the other wrench jaw, respectively, presses in an undefined way against the hexagonal object without lying flat against its surface. Consequently, a self-clamping action is not obtained; rather, the clamping force with which the hexagonal object is held between the wrench jaws must be applied manually by the user by means of a pincer action, in that he squeezes the two limbs of the handle together. For this purpose, the two limbs of the handle must be made adequately rigid and their angular position in every position for use must be such that the required clamping force can be applied manually.

In the case of fittings wrenches, which have smooth clamping surfaces (DE 195 18 555 C2), the clamping of the hexagonal object takes place only by means of the manually exerted closing force and not with a self-clamping action. This manual closing is sufficient, since in the case of the fittings concerned here the hexagonal objects are only screwed against elastic sealing material. These fittings wrenches often have a serrated single joint which is adjustable in small adjusting steps.

In the case of a known pipe wrench with serrated clamping surfaces (U.S. Pat. No. 6,026,714), which has an upper wrench jaw with a planar clamping surface and a stop and a lower wrench jaw with a convexly curved clamping cam surface, self-locking can only be achieved by the very short clamping surfaces formed by the individual serrations meeting the prerequisite required for self-locking, that the respective pivot point of the single joint lies on a perpendicular to the serration surface acting on the hexagonal object. Since, however, this self-clamping condition is satisfied only for the individual serration respectively acting directly on a corner of the hexagonal object, the entire clamping force is transmitted via this single serration in the immediate vicinity of the corner of the hexagonal object. The high local stressing which occurs leads to the hexagonal object being damaged if a relatively high torque is applied and/or the hexagonal object consists of low-strength material. In the case of hexagonal objects with rounded corners, self-clamping is no longer possible and further rounding and damaging of the hexagonal object is unavoidable.

Therefore, in the same way as in the case of serrated water-pump wrenches, in the case of such pipe wrenches a self-clamping action only occurs by chance and not reliably, via the serrations and in dependence on the respective formation of the corners of the hexagonal object. Therefore, there is the risk of the wrench slipping off and of injuries and accidents occurring.

Hexagonal objects with already rounded corners, for example already damaged nuts or screw heads, are further damaged by the wrenches slipping off, and therefore become unusable. The serrations of the clamping surfaces of the wrenches remove further material from the corners of the hexagonal objects. The wrench slips off completely. This damaging effect is further exacerbated by the fact that, to achieve a high torque, an increased clamping force is exerted on the wrench. As a result of the severe damage to the hexagonal object, it can no longer be loosened even with a self-clamping clamping wrench or with a rigid fixed wrench of the right size.

In the case of a known clamping wrench with smooth clamping surfaces aligned parallel to each other, the lower, movable wrench jaw is guided in a sliding manner with respect to the upper wrench jaw, which is rigidly connected to its part of the handle. A second part of the handle is mounted in a single joint which is adjustable along a serration arrangement and has a driving cam, which acts on the longitudinally displaceable lower wrench jaw. This known clamping wrench comprises more than three parts which are movable with respect to one another and is therefore of a relatively complicated construction and is thus costly to produce. With this clamping wrench, self-clamping is achieved with a force acting on the flank surfaces of the hexagonal object, but only with the great complexity and cost described. Furthermore, adjustability of the single joint with close graduation is required.

In addition, there are known self-clamping clamping wrenches for hexagonal objects (U.S. Pat. No. 4,651,597) in which a lower, convexly curved clamping surface presses the hexagonal object with a self-clamping action against the clamping surface of the upper wrench jaw. This upper wrench jaw is in this case not connected to a limb of the handle; its mounting on the lower wrench jaw is not longitudinally displaceable, with the result that adaptation to hexagonal objects of different sizes can take place only by changing the pivoting position of the upper wrench jaw. As a result, the range of use is restricted; use in a way similar to pincers is ruled out because of the absence of a second limb of the handle connected to the upper wrench jaw.

SUMMARY OF THE INVENTION

It is therefore an object of the invention to form a clamping wrench of the generic type stated at the beginning in such a way that it can be ensured that hexagonal objects of different widths across flats in a wide range can in each case be received in a defined manner between the wrench jaws and that a self-clamping action is obtained in the entire range of use, with the result that the wrench function is required only for opening and closing the clamping wrench. In particular, the action of the clamping wrench on the hexagonal object is to be self-locking with smooth clamping surfaces, i.e. without the use of serrations. The self-locking action is not to take place by chance or in dependence on the respective formation of the corners of the hexagonal object. The pressure required for transmitting the torque is to be exerted exclusively on the flank surfaces of the hexagonal object and not on its corners. The clamping wrench is to be rapidly adjustable and, even in the case of a ratcheting operation, opened only to the extent that it can still be gripped with the hand. As in the case of a ratchet screwdriver, progressive gripping in 60° steps is to be possible. The adjusting possibilities for the clamping wrench are to cover the entire range of sizes of hexagonal objects in an overlapping manner. When there is an increase in the torque, an increasingly stronger self-clamping action is to occur.

This complex object, in which however all the elements of it are indispensable, is achieved by a clamping wrench of the generic type stated at the beginning which, according to the invention, has the following features:

a) the upper wrench jaw has a planar smooth clamping surface and a stop;
b) in the most closed position of the clamping wrench, the pivot axis of the single joint lies approximately on a straight line which is perpendicular to the plane of the clamping surface at the inner corner point of the flank surface of the hexagonal object to be clamped lying against the clamping surface;
c) the lower wrench jaw has a convexly curved smooth clamping cam surface;
d) in the case of hexagonal objects of all widths across flats to be received, the points of action of the clamping cam surface lie in the front half of the respectively associated lower flank surface of the hexagonal object to be clamped.

This achieves the effect that hexagonal objects with different widths across flats in a large range can be received and clamped in fundamentally the same way, that is by the convexly curved clamping surface of the lower wrench jaw pressing onto a flank surface of the hexagonal object and, as a result, pressing the latter with two opposite flank surfaces to lie flat against the clamping surface of the upper wrench jaw. When a torque is applied to the hexagonal object, in this case a self-clamping action occurs, with the result that substantially only the outer limb of the handle, connected to the lower wrench jaw, serves for transmitting the torque, with the result that only this limb of the handle has to be made correspondingly rigid. The other, inner limb of the handle, connected to the upper wrench jaw, can be made much lighter and thinner, also from lighter material, such as plastic or sheet metal, since it serves only for the opening and closing of the clamping wrench.

The smooth form of the clamping surface ensures that the compressive forces exerted to apply the torque act only on the flank surfaces and not on the corners of the hexagonal object. This rules out damage to the hexagonal object, in particular its corners, or slipping off of the clamping wrench, leading to the risk of an accident. The clamping wrench is of a simple construction and therefore can be produced at low cost. The clamping wrench comprises only two movable parts. Even when the clamping wrench is designed for a wide range of sizes of hexagonal objects, the head of the wrench remains small. The wrench can therefore even be used in confined spaces.

The used terms "inner" and "outer" relate here to the mouth opening of the wrench.

According to a preferred embodiment of the invention, it is provided that the upper wrench jaw has between the stop and the adjustable single joint a recess extending beyond the hexagon surface of the largest hexagonal object to be clamped.

This achieves the effect that the clamping wrench only has to be opened slightly to be brought onto the hexagonal object after a step turning it into the respective next clamping position. This permits a ratchet-like movement of the clamping wrench on the hexagonal object.

Further advantageous configurations of the idea of the invention are the subject of further subclaims.

An exemplary embodiment of the invention is explained in more detail below and is represented in the drawing, in which:

DETAILED DESCRIPTION OF THE PREFERRED EMBODIMENT

Figure 1:
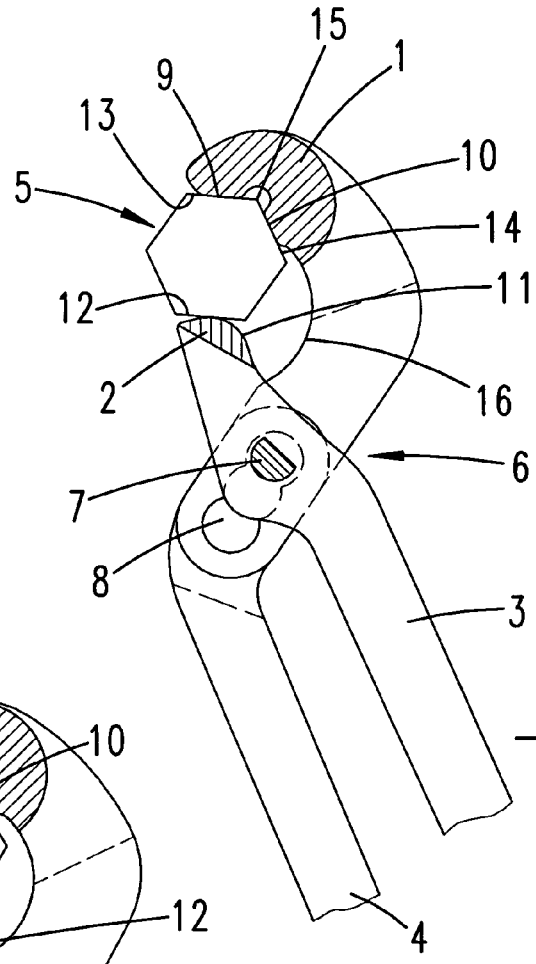
FIGS. 1–6 show a clamping wrench in different positions of acting on hexagonal objects of different widths across flats.
Figure 2:
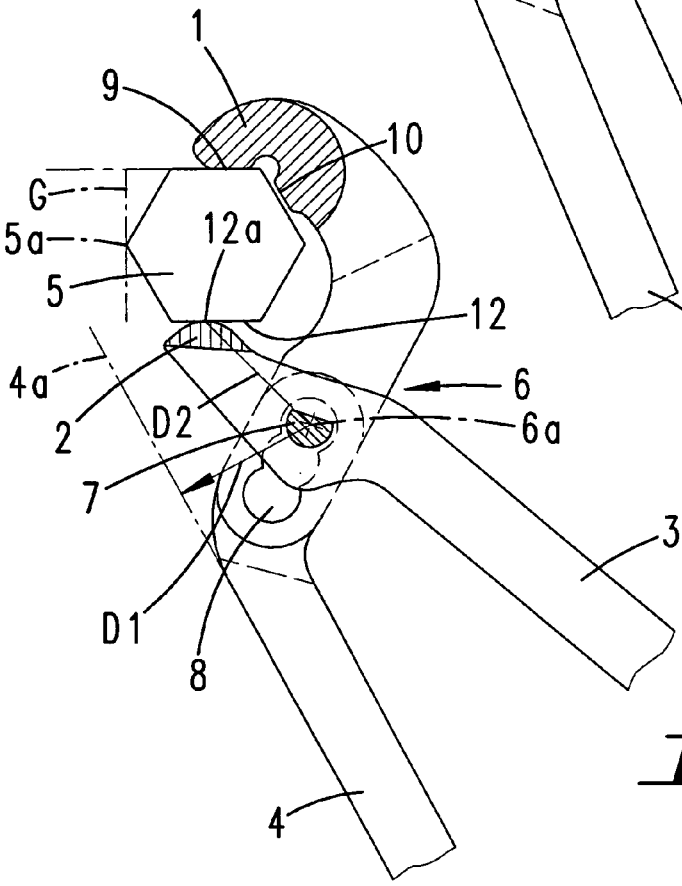
Figure 3:
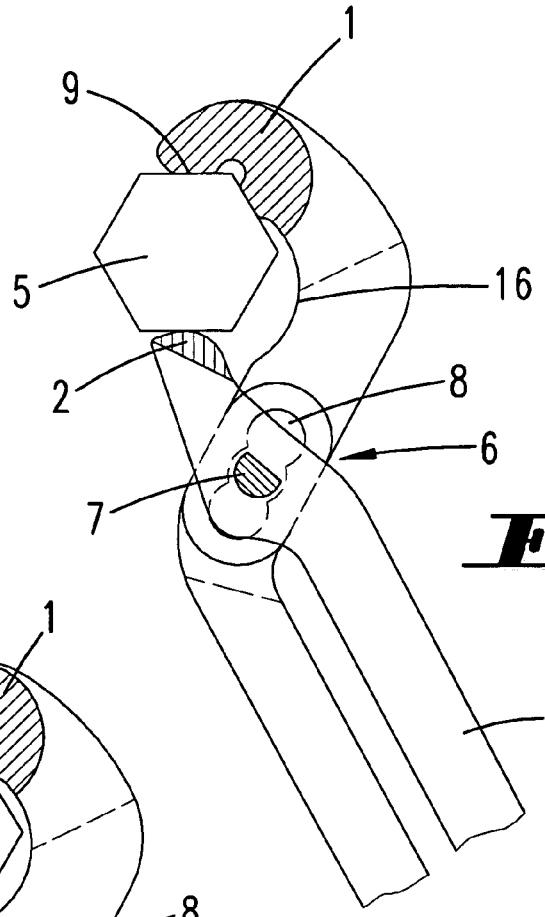
Figure 4:
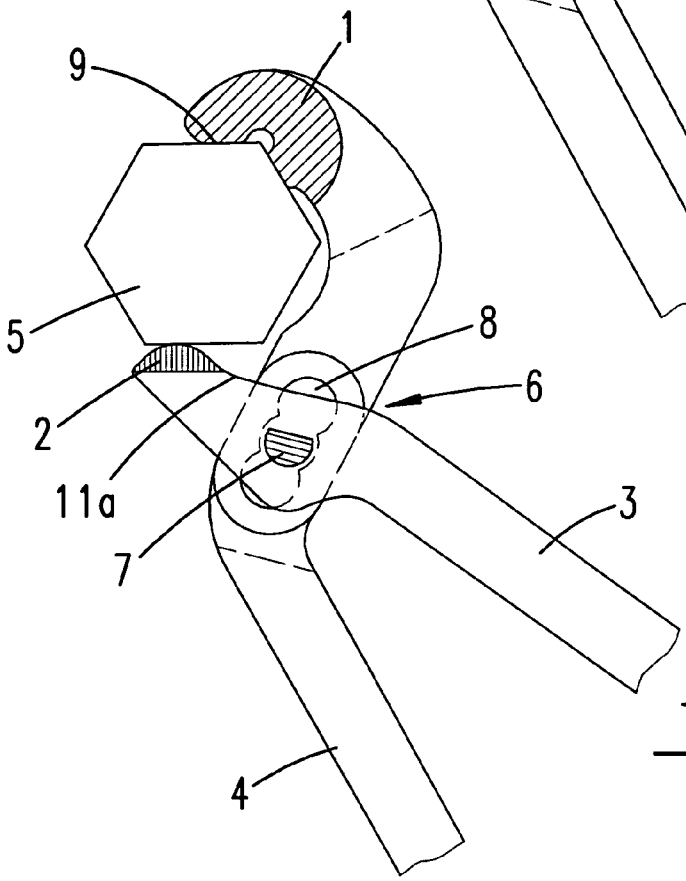

The clamping wrench represented in the drawing has an upper wrench jaw 1 and a lower wrench jaw 2. Use of the terms "upper" and "lower" relate here to the customary position for use of such a clamping wrench, as represented in FIGS. 1–9, in which a user is holding the adjustable wrench jaw with the right hand in order to exert a torque in the clockwise direction on the hexagonal object 5 respectively received.

The lower wrench jaw 2 is connected to a first limb 3 of the handle. The upper wrench jaw 1 is connected to a second limb 4 of the handle.

The two wrench jaws 1 and 2 are pivotably connected to each other in a conventional longitudinally adjustable single joint 6. Such longitudinally adjustable single joints are customary in the case of water-pump wrenches or fittings wrenches. As in the case of the exemplary embodiment represented, they have for example a cylindrical joint pin 7, which is flattened on one side and is longitudinally displaceable in a guide slot 8 of the other part of the single joint when the clamping wrench is fully open. For this purpose, the guide slot 8 comprises a number of cylindrical bores intersecting one another, with a bore diameter corresponding to the joint pin 7. In the respective clamping position, the joint pin 7 is received in one of the bores of the guide slot 8 in such a way that it can pivot, but cannot be displaced in the longitudinal direction of the slot, as is represented in all of FIGS. 1–9.

Figure 5:
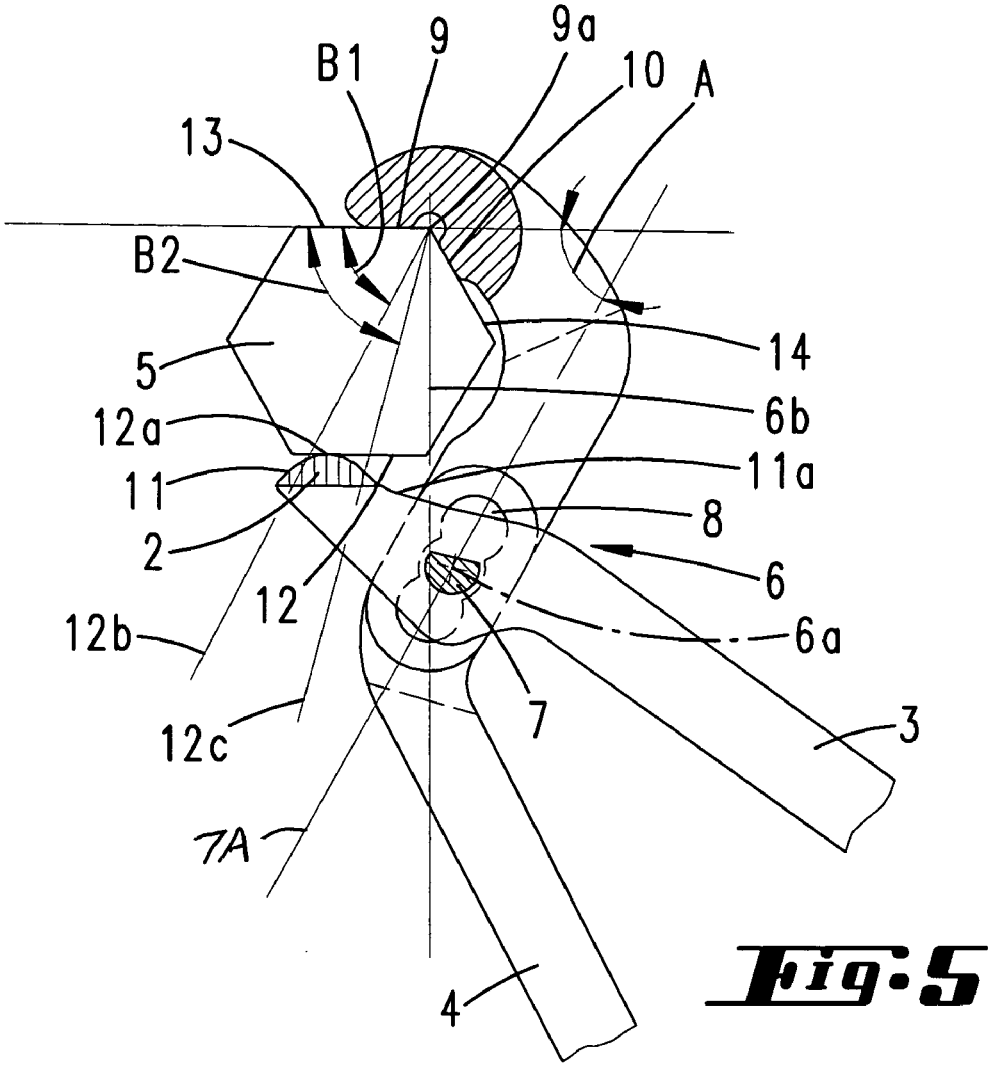

In addition, so-called superposed adjustable single joints are also known in the case of water-pump wrenches and can also be used in a corresponding way in the case of the clamping wrench represented, in particular if higher forces to are to be absorbed. The adjusting direction of the pivot pin 7 along the longitudinally adjustable single joint 6, which has at least two positions, three positions shown in the drawing in the case of the exemplary embodiment presented, runs here for example along a line 7A inclined at an angle A of approximately 60° in relation to the clamping surface 9 (FIG. 5)

The upper wrench jaw 1 has a planar smooth clamping surface 9 and a stop surface 10, for example in the form of a stop surface 10 angled away from surface 9 by 120°. In the most closed position of the clamping wrench while enveloping the object 5, the pivot axis 6*a* of the single joint 6 lies approximately on a straight line 6*b* which is perpendicular to the plane of the clamping surface 9 at the inner corner point 9*a* of the edge of the hexagon lying against the clamping surface 9. The lower clamping jaw 2 has a convexly curved smooth clamping cam surface 11, which lies against the respectively associated lower flank surface 12 in the case of hexagonal objects 5 of all widths across flats to be received, as can be seen from the representation in FIGS. 1–6 and 9. In the case of hexagonal objects 5 of all widths across flats to be received, the points of action 12*a* of the clamping cam surface 11 lie in the front half of the respectively associated flank surface 12 of the hexagonal object 5. This results from the fact that, in the case of hexagonal objects 5 of all widths across flats to be received, the points of action 12*a* of the clamping cam surface 11 lie between two straight lines 12*b*, 12*c* which, at the inner corner point 9*a*, form with the clamping surface 9 angles B1 and B2, respectively, of approximately 53° and 67°.

As a result, the hexagonal object 5 respectively received, for example a nut, a screw head or a union nut of a screwed pipe connection, is pressed with its flank surface 13 lying opposite the flank surface 12 against the clamping surface 9 of the upper wrench jaw 1. The flank surface 14 lies against the stop 10.

Behind the convexly curved clamping cam surface 11 of the lower wrench jaw 2 there follows on the joint side an indentation 11*a*. This achieves the effect that progressive gripping of the clamping wrench takes place without excessive opening of the wrench, i.e. the two limbs 3 and 4 of the handle need only be opened to the extent that they can still be held comfortably with one hand.

The self-clamping action of the clamping wrench is provided by the fact that, in all positions of the single joint 6, the pivot axis 6*a*, respectively determined by the axis of the joint pin 7, lies on a straight line 6*b* which is perpendicular to the plane of the clamping surface 9 at the inner corner point 9*a* of the edge of the hexagon surface lying against the clamping surface 9. In spite of the possibility of longitudinal adjustment of the single joint 6, these self-clamping conditions of the clamping wrench are retained.

Figure 6:
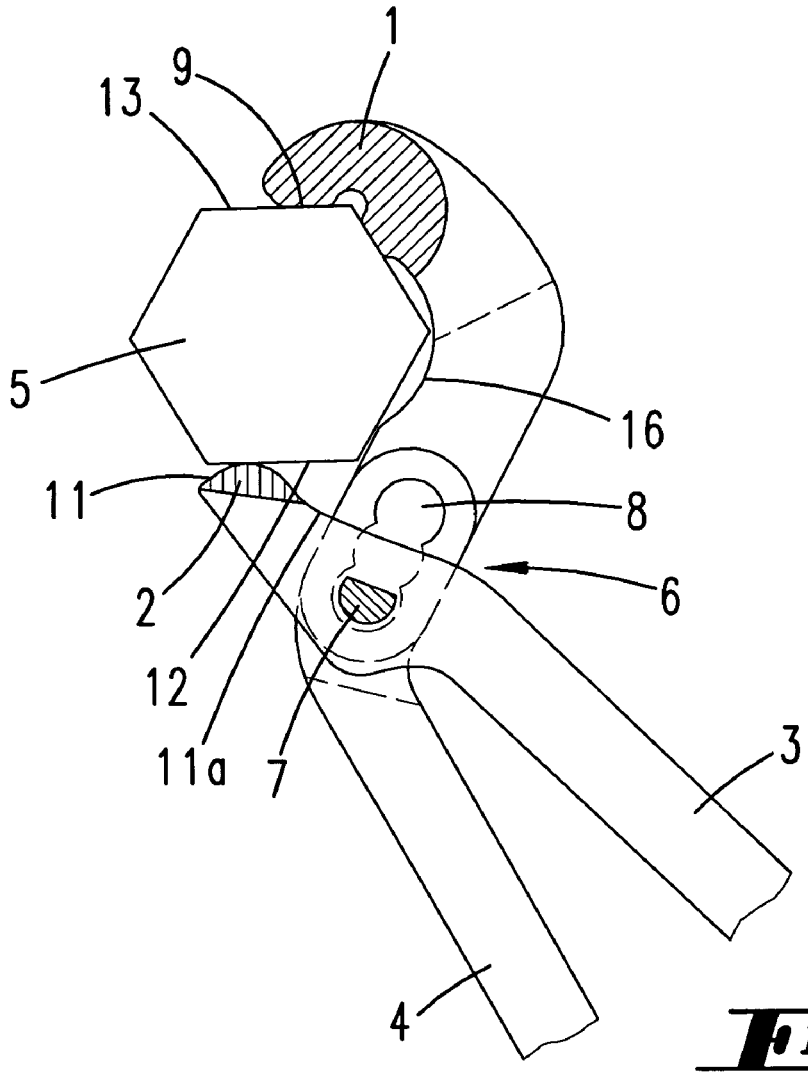
Figure 7:
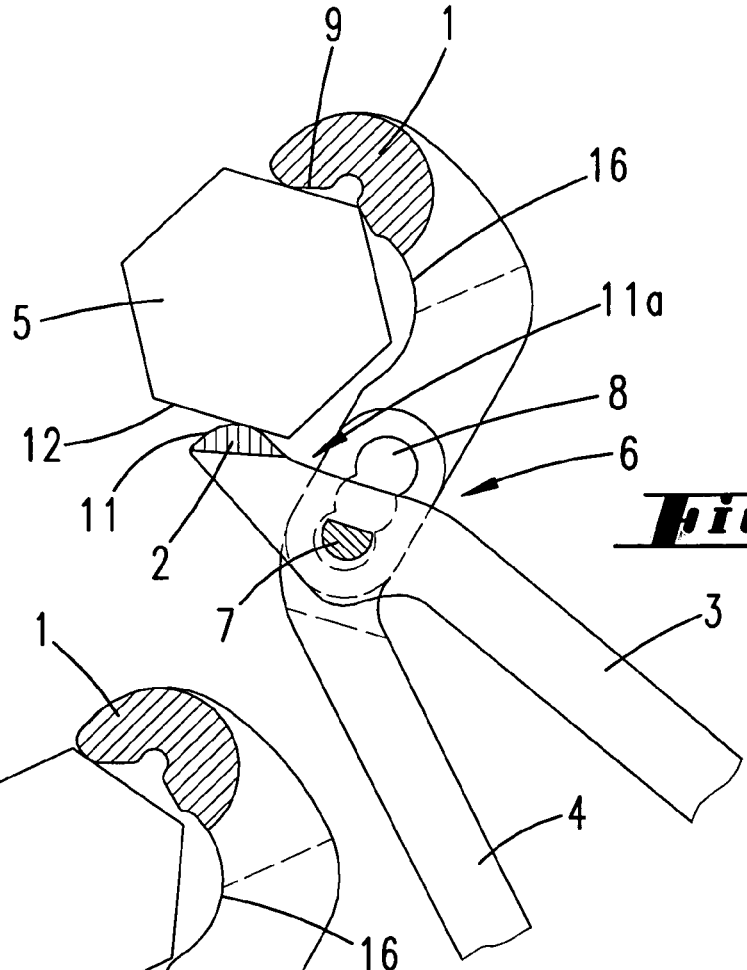
FIGS. 7 and 8 show successive steps during grasping, starting from the clamping position according to FIG. 6
Figure 8:
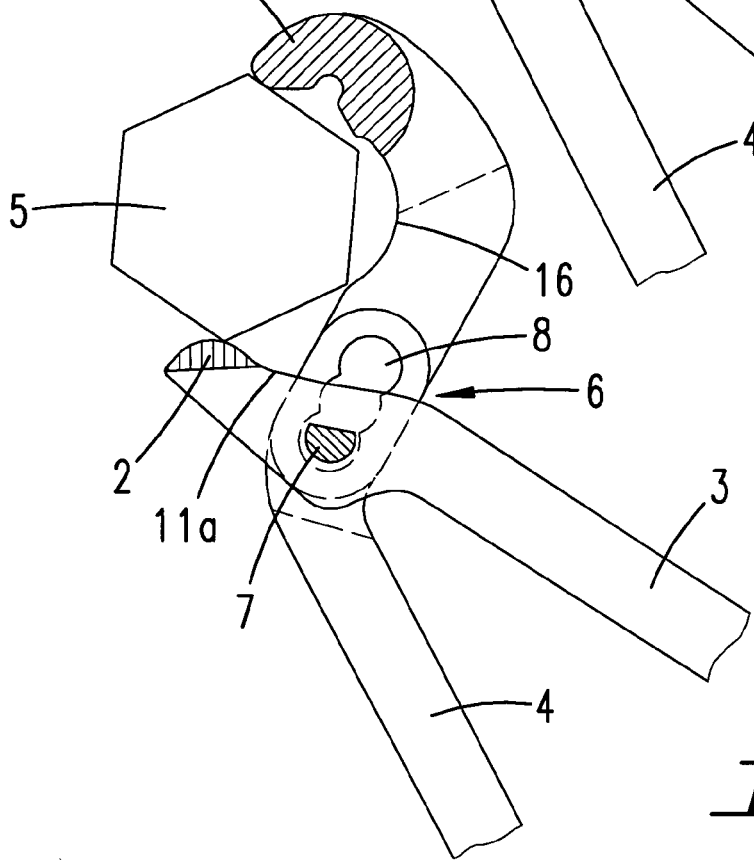

The upper wrench jaw 1 has between its stop surface 10 and the adjustable single joint 6 a recess 16 extending beyond the hexagon surface of the largest hexagon 5 to be received (represented in FIG. 6). As represented in FIGS. 7 and 8, this recess 16 facilitates the progressive gripping of the clamping wrench when, starting from the clamping position shown in FIG. 6, the next corner respectively of the hexagonal object 5 is to be received between the two clamping surfaces 9 and 10.

As can be seen particularly clearly from FIG. 6, in which the largest hexagonal object 5 to be received is represented, the upper wrench jaw 1 reaches only to approximately the center of the flank surface 13 of this largest hexagonal object 5 to be received lying against the front clamping surface 9. This facilitates grasping without the clamping wrench being opened more than it should. The lower wrench jaw 2 does not protrude beyond the convexly curved clamping cam surface 11 at which the lower wrench jaw 2 lies against the flank surface 12. It is advantageous that the lower wrench jaw 2 does not protrude beyond a limiting line G, which runs from the outermost corner point 5*a* of the hexagon perpendicularly in relation to the plane of the clamping surface 9.

Figure 9:
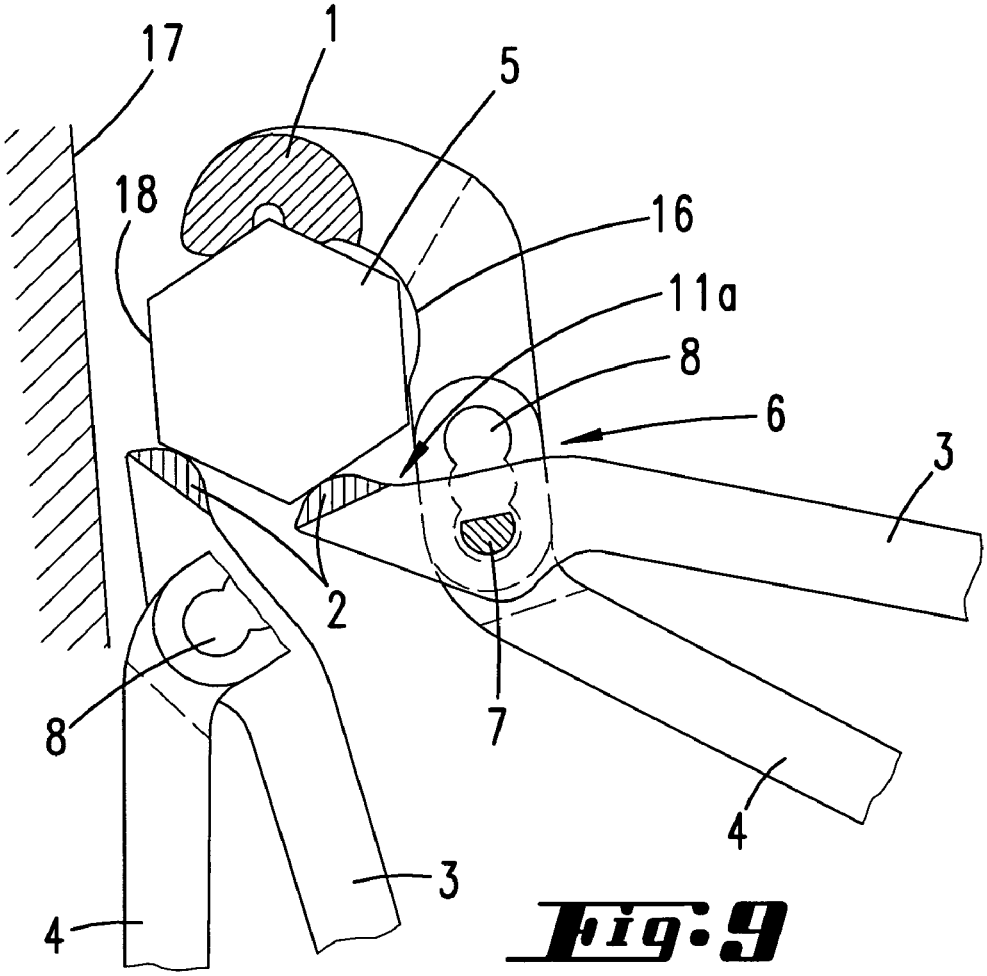
FIG. 9 shows the use of the clamping wrench on a hexagonal object which is disposed near a wall.

Therefore, in comparison with a conventional water-pump wrench, the two wrench jaws 1 and 2 are made very short, without this impairing the clamping action on a hexagonal object 5. This produces the advantage that the clamping wrench can be used on a hexagonal object 5 even if this hexagonal object 5 is in the direct proximity of a wall 17 or is located on some other obstacle, as represented in FIG. 9. FIG. 9 shows the clamping wrench at the beginning of a movement turning the hexagonal object 5 in the clockwise direction. It can be seen that the upper wrench jaw 1 does not protrude beyond the flank surface 18 of the hexagonal object 5 facing the wall 17. The clamping wrench is then also partly represented in FIG. 9 at the end of a movement turning by 60°, so that it can be seen that even then the wall 17 does not get in the way.

In this case it is advantageous that the distance D1 of the outer limiting surface 4*a* of the limb 4 of the handle connected to the upper wrench jaw 1 from the pivot axis 6*a* of the single joint 6 is equal to or less than the distance D2 of the pivot axis 6*b* from the point of action 12*a* of the clamping cam surface 11.

The invention claimed is:

1. Clamping wrench for gripping a hexagonal object, the wrench comprising an upper wrench jaw and a lower wrench jaw, which are connected in a unitary manner respectively to a first handle and a second handle of the wrench, the wrench jaws being pivotably connected via a pivot to each other in a longitudinally adjustable joint, wherein:

a) the upper wrench jaw (1) has a planar smooth clamping surface (9) and a stop surface (10) inclined to the clamping surface at an angle of 120 degrees for reception of adjacent flank surfaces of the hexagonal object upon insertion of the object between the jaws;

b) the lower wrench jaw (2) has a convexly curved smooth clamping cam surface (11) protruding from the lower wrench jaw in a direction towards the upper wrench jaw, which protrusion lies on a side of a bisector of the upper jaw angle facing the pivot for engaging the hexagonal object upon emplacement of the object between the jaws, the protrusion extending along a region of the lower wrench jaw less than the extent of a flank of a hexagonal object to be inserted between the jaws;

c) in cases of hexagonal objects (5) of differing widths across flats to be received by the wrench, points of action (12*a*) of the clamping cam surface (11) of the lower jaw lie in a front half of a lower flank surface (12) of the hexagonal object (5) being clamped by the jaws of the wrench upon insertion of the object between the jaws.

2. Clamping wrench according to claim 1, wherein an adjusting direction of the pin 7 of the single joint (6), which pin is longitudinally adjustable along the first handle into at least two positions, runs along a line oriented at an angle (A) of approximately 60° in relation to the clamping surface (9).

3. Clamping wrench according to claim 1, further comprising a recess (16) located on the first handle between the stop surface (10) and the adjustable single joint (6), wherein during a gripping of the object by the wrench, the recess (16) extends beyond a hexagon surface of the largest hexagonal object (5) to be clamped.

4. Clamping wrench according to claim 1, wherein behind the convexly curved clamping cam surface (11) there follows on a joint side an indentation (11*a*).

5. Clamping wrench according to claim 1, wherein the upper wrench jaw (1) reaches only to approximately a center of a flank surface (13) of a largest hexagonal object (5) to be clamped lying against the clamping surface (9).

6. Clamping wrench according to claim 1, wherein no part of the lower wrench jaw (2) protrudes beyond the convexly curved clamping surface (11) toward the upper jaw.

7. Clamping wrench according to claim 1, wherein, in a case of hexagonal objects (5) of all widths across flats to be received, points of action (12*a*) of the clamping cam surface (11) lie between two straight lines (12*b*, 12*c*) which extend from a vertex of the clamping surface and the stop surface, the two straight: lines defining relative to the clamping surface (9) an angular range (B1 B2) of approximately 53° to 67°.

8. Clamping wrench according to claim 1, wherein the lower wrench jaw (2) does not protrude beyond a limiting line (G), which runs from an outermost corner point (5*a*) of the hexagonal object (5) to be clamped perpendicularly in relation to a plane of the clamping surface (9).

9. Clamping wrench according to claim 1, wherein a distance (D1) of an outer limiting surface (4*a*) of the first handle (4) connected to the upper wrench jaw (1) from the pivot axis (6*a*) of the joint (6) is equal to or less than a distance (D2) of the pivot axis (6*a*) from the point of action (12*a*) of the clamping cam surface (11).

10. Clamping wrench according to claim 1, wherein in a most closed position of the clamping wrench during a gripping of the object, a pivot axis (6*a*) of the single joint (6) lies approximately on a straight line (6*b*) which is perpendicular to a plane of the clamping surface (9) at an inner corner point (9*a*) of a flank surface of the hexagonal object (5) lying against the clamping surface (9).

* * * * *